United States Patent [19]

Baymiller

[11] Patent Number: 4,854,624

[45] Date of Patent: Aug. 8, 1989

[54] DEVICE FOR PICKING UP ANIMAL FECES

[76] Inventor: Sharon R. Baymiller, 170 John St., Apt. 3A, New York, N.Y. 10038

[21] Appl. No.: 176,938

[22] Filed: Apr. 4, 1988

[51] Int. Cl.[4] ..... A01K 29/00

[52] U.S. Cl. ..... 294/1.3

[58] Field of Search ..... 294/1.3, 1.2, 1.4, 25, 294/55, 41 B, 113, 115; 15/104.8, 257.1, 257.6; 206/496

[56] References Cited

U.S. PATENT DOCUMENTS 3,407,927 10/1968 Jones ..... 294/1.3

3,685,088 8/1972 Doherty ..... 294/1.3

3,848,906 11/1974 Fleishman ..... 294/1.3

4,747,633 5/1988 Stacy ..... 294/1.3

*Primary Examiner*—James B. Marbert

*Attorney, Agent, or Firm*—Merchant, Gould, Smith, Edell, Welter & Schmidt

[57] ABSTRACT

A feces pick up device includes a sheet with a pair of finger holders. The sheet is bendable significantly easier in one direction than the other. Once feces has been picked up by the device, together they are deposited in a paper bag for disposal.

3 Claims, 2 Drawing Sheets

DEVICE FOR PICKING UP ANIMAL FECES

FIELD OF THE INVENTION

The present invention is directed to the general category of accessories for animal owners and, more particularly, to a device for picking up animal feces, usually that from a dog.

BACKGROUND OF THE INVENTION

Many cities and towns have ordinances which require the owner of an animal to pick up its droppings so that they do not litter sidewalks and parks. Variously designed shovels or scoops are common with the idea that once the feces is on the shovel, it may be dropped into a bag or other waste container. Such devices are not wholly satisfactory since the shovel is then soiled and can be quite unpleasant to carry home or to a place where it can be cleaned.

Disposable, biodegradable scoopers are clearly more desirable. A recent model is made from semi-rigid paperboard and is formed with a centrally located hinge axis. A pair of plane-like walls extend away from the axis. Bottom walls extend from each of the plane-like walls toward one another and have serrated facing edges for scooping under the feces. Triangular side walls connect the plane-like and bottom walls. One side of the device fits inside the other side to capture and enclose the feces. A handle is attached on the outer side of each of the plane-like walls so as to allow a person to operate the device about the hinge axis. The problem with this device is that it is quite complex and, consequently, expensive, especially considering its purpose. The present invention, on the other hand, is very simple and, therefore, sufficiently inexpensive to be affordable by anyone needing it.

DETAILED DESCRIPTION OF THE PREFERRED EMBODIMENT

Figure 1:
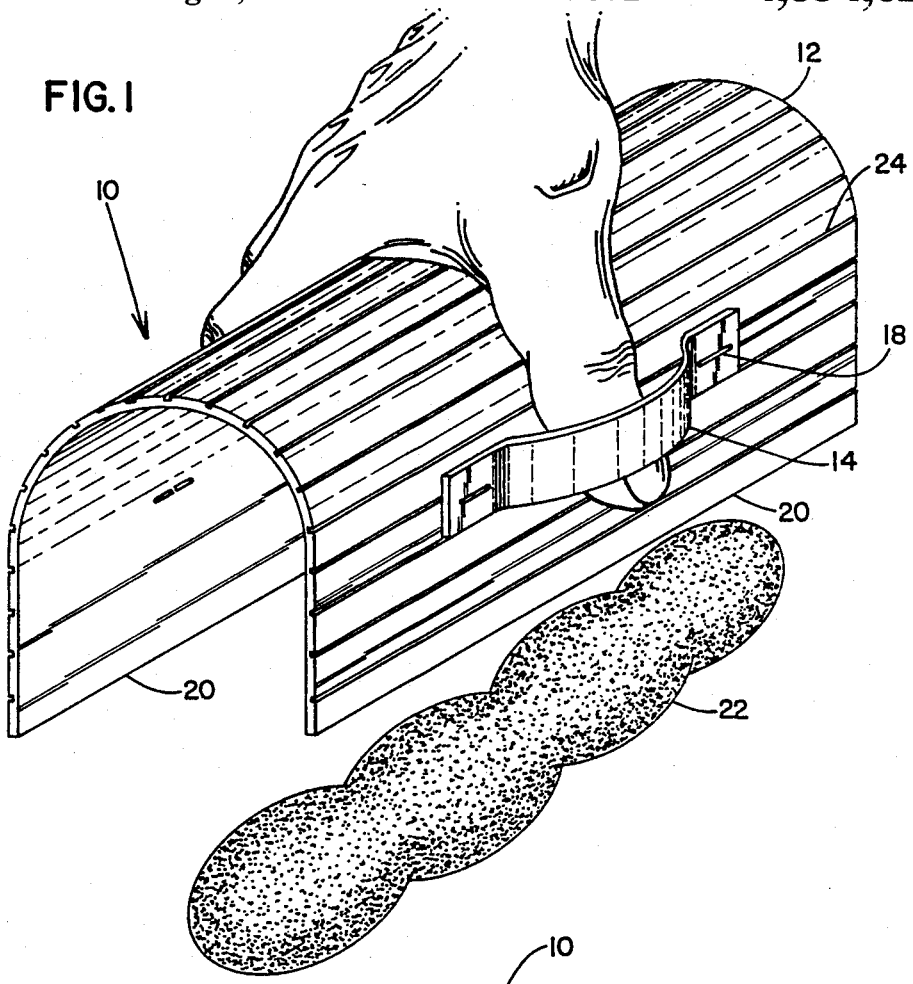
FIG. 1 is a perspective view illustrating the use of a device in accordance with the present invention.

Referring now to the drawings wherein like reference numerals designate identical parts or features throughout the several views and, and referring more particularly to FIG. 1, a device for picking up animal feces in accordance with the present invention is designated generally by the numeral 10. Device 10 includes a sheet of paperboard 12 having a pair of finger holders 14 and 16 attached to the sheet with staples 18.

Figure 2:
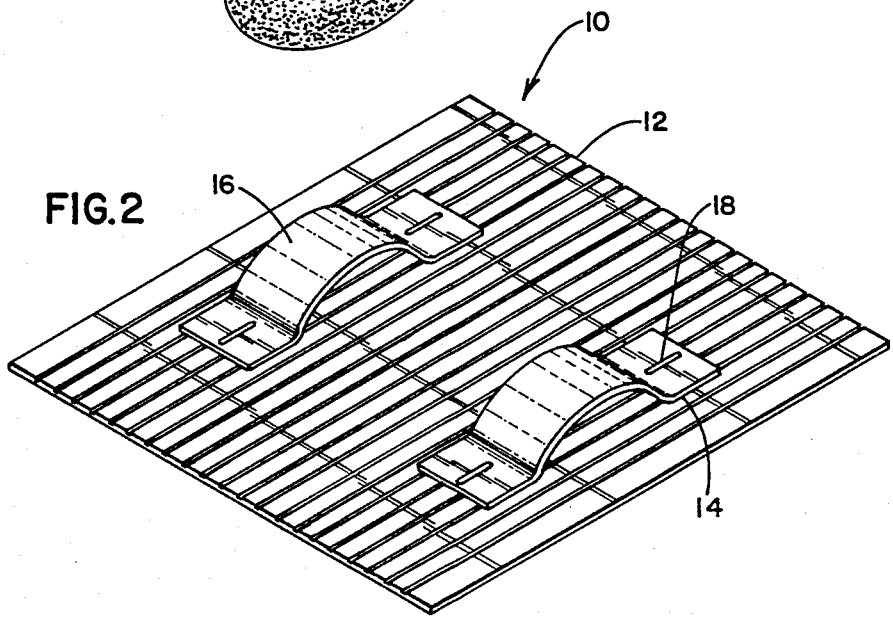
FIG. 2 is a perspective view showing the device of FIG. 1 in a flat, packagable configuration.

Sheet 12 is generally rectangular. Of more importance, however, is that sheet 12 have a pair of opposite edges 20 which are preferably straight so that they readily cut under a piece of feces 22. Sheet 12 also includes a plurality of weakened lines 24 which are generally parallel with edges 20. As a result, the sheet is bendable arcuately about axes or a movable axis which is also generally parallel with edges 20. In addition, lines 24 are formed so that the bending of sheet 12 is significantly easier in one direction than the other. Furthermore, a sufficient number of lines 24 are present on both sides of each of finger holders 14 and 16 as shown in FIGS. 1 and 2 so that the fingers and thumb of the operator can readily push sheet 12 against the ground and control the bending of it so that edges 20 move toward one another and cut under feces 22. In this regard, sheet 12 has a first side facing the axis of the arcuate bend. The first side of sheet 12 is the side which receives feces 22. A second side of sheet 12 which is opposite the first side receives finger holders 14 and 16. One of each of the pair of finger holders 14 and 16 is attached nearer to one edge 20 than the other. In this way, there is a finger holder on each side of the centerline of sheet 12 so that sheet 12 may be manuevered as indicated. Preferably, each end of finger holders 14 and 16 is stapled to sheet 12. Alternatively, the ends may be fastened with adhesive. In any case, finger holders 14 and 16 include sufficient paperboard so that they may extend somewhat outwardly from sheet 12 in order to comfortably receive a finger or thumb.

Figure 3:
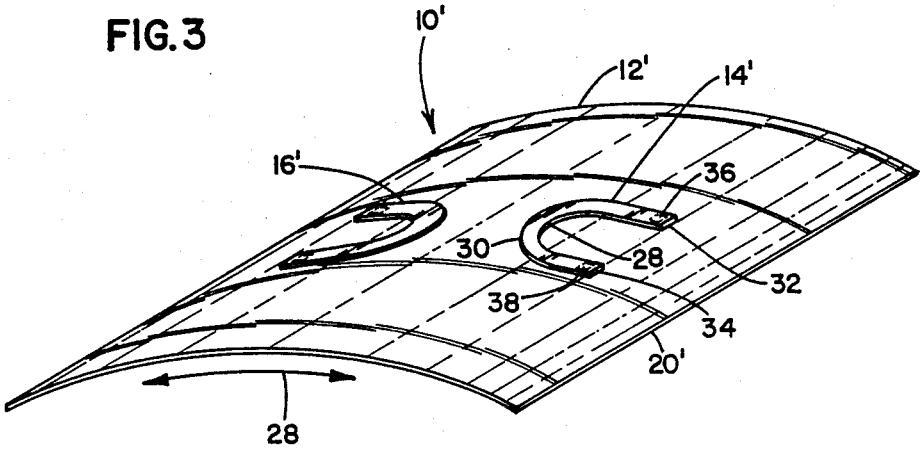
FIG. 3 is a perspective view of an alternate embodiment.

In the alternate embodiment shown in FIG. 3, parts or features which are similar to those described with respect to FIGS. 1 and 2 are designated by the same numerals, only the numerals are primed. Device 10' includes a sheet 12' with a pair of finger holders 14' and 16'.

Sheet 12' is a rectangular piece of paperboard having a natural grain generally perpendicular to the axis of bending, i.e., in the general direction indicated by arrow 26. Such natural grain causes paperboard sheet 12' to assume a naturally arcuate shape. Sheet 12' also has a pair of opposite straight edges 20'. Because of the natural grain of sheet 12', there are no weakened lines similar to lines 24 of device 10. Nevertheless, sheet 12' bends arcuately about one or more axes generally parallel with edges 20', and it bends significantly easier in one direction than in the other. Sheet 12' has a first side facing the indicated axis, which side receives the feces. Sheet 12' also has a second side opposite the first side. Finger holders 14' and 16' are attached to the second side. Finger holder 14', for example, is made of flat paperboard cut to have a first set of opposite arcuate edges 28 and 30. Preferably 28 and 30 are semi-circular. In addition, finger holder 14' has a second set of straight edges 32 and 34 which are aligned generally along the same straight line. An end portion 36 and 38 near each of edges 32 and 34 is preferably attached adhesively to the second side of sheet 12'. Finger holders 14' and 16' are located with respect to sheet 12' such that the arcuate edges of a particular one of finger holders 14' and 16' are farther from the nearer sheet straight edge 20' than are the finger holder straight edges for that particular finger holder. In the case of finger holder 14', edges 28 and 30 are farther from the nearer edge 20' than are straight edges 32 and 34. In this way, a person can place one or more fingers under the arcuate portion of finger holder 16' and can place a thumb under the arcuate portion of finger holder 14' thereby flexing the arcuate portions of each finger holder outwardly from sheet 12'. At the same time that the finger holders are flexing outwardly, force is being applied to opposite side portions of sheet 12' causing it to assume an even tighter arcuate shape. When the fingers and thumb are in place, sheet 12' is readily controlled so that edges 20 may be placed on the ground and bent toward one another to scoop under a piece of feces.

In the use of either embodiment, the animal owner places the fingers and thumb of one hand in the opposite ones of the finger holders of the particular device for picking up feces. The device is then placed so that the straight edges contact the ground and bend inwardly. As the hand is closed, the straight edges scoop under the feces so that it is captured. The feces and the picking up device are then either deposited in a trash container or deposited first in a paper bag and then in a trash container. The device and method of use particularly appropriate for thoughtful animal owners since the use of such device removes unpleasant waste and provides for a biodegradable disposition of it.

Although the present invention is simple, it is understood that there may be equivalents. Consequently, any changes in size, shape, or any other feature is understood to be within the spirit and principle of the present invention to the full extent of the meaning of the claims which follow.

What is claimed is:

1. Device for picking up animal feces, comprising:

a sheet of paperboard having a pair of opposite straight edges, said sheet having a first side facing said axis and a second side opposite;

a pair of finger holders; and means for attaching said finger holders to said second side, one of said finger holders being nearer one of said edges than the other edge and the other of said finger holders being nearer the other edge than said one edge, said sheet including between each set of one of said finger holders and the straight edge nearest said one finger holder, means for bending arcuately on contact with ground about an axis generally parallel with said edges, said bending means bending significantly easier in one direction than a direction opposite.

2. The device in accordance with claim 1 wherein said finger holders comprise flat paperboard cut to have a first set of opposite arcuate edges and a second set of straight edges aligned generally along a straight line, said finger holders being located with respect to said sheet so that said arcuate edges for a particular one of said finger holders are farther from the nearer sheet straight edge than are said finger holder straight edges for said particular finger holder.

3. The device in accordance with claim 1 wherein said sheet has a grain generally perpendicular to said edges.

* * * * *